US011247893B2

(12) United States Patent
Rudick et al.

(10) Patent No.: US 11,247,893 B2
(45) Date of Patent: Feb. 15, 2022

(54) MODULAR SYSTEM FOR DISPENSING ADDITIONAL INGREDIENTS

(71) Applicant: The Coca-Cola Company, Atlanta, GA (US)

(72) Inventors: Arthur G. Rudick, Atlanta, GA (US); Raymond J. Vanassche, Atlanta, GA (US); Andrew David Beal, Wantima South (AU); Kim Ritchie Lester, Monbulk (AU); Neil Paul P. Sanut, Pakenham (AU)

(73) Assignee: THE COCA-COLA COMPANY, Atlanta, GA (US)

( * ) Notice: Subject to any disclaimer, the term of this patent is extended or adjusted under 35 U.S.C. 154(b) by 17 days.

(21) Appl. No.: 15/748,367

(22) PCT Filed: Jul. 28, 2016

(86) PCT No.: PCT/US2016/044521

§ 371 (c)(1),
(2) Date: Jan. 29, 2018

(87) PCT Pub. No.: WO2017/019880

PCT Pub. Date: Feb. 2, 2017

(65) Prior Publication Data

US 2018/0215604 A1 Aug. 2, 2018

Related U.S. Application Data

(60) Provisional application No. 62/198,498, filed on Jul. 29, 2015.

(51) Int. Cl.

| | |
|---|---|
| ***B67D 1/00*** | (2006.01) |
| ***B67D 1/08*** | (2006.01) |
| ***B65D 77/06*** | (2006.01) |

(52) U.S. Cl.
CPC ..... *B67D 1/0888* (2013.01); *B67D 1/0021* (2013.01); *B67D 1/0892* (2013.01);
(Continued)

(58) Field of Classification Search
CPC .... B65D 77/06; B67D 1/0888; B67D 1/0021; B67D 1/0892; B67D 2210/00034; B67D 2210/0034
(Continued)

(56) References Cited

U.S. PATENT DOCUMENTS 5,341,957 A * 8/1994 Sizemore ..... G07F 13/065 222/105
5,540,556 A * 7/1996 Du ..... F04B 43/0045 417/238
(Continued)

FOREIGN PATENT DOCUMENTS

WO 2013063463 A1 5/2013

OTHER PUBLICATIONS

Search Report, EP 16831363.3, dated Feb. 1, 2019 (9 pp.).

*Primary Examiner* — Frederick C Nicolas
(74) *Attorney, Agent, or Firm* — Eversheds Sutherland (US) LLP

(57) ABSTRACT

A dispensing system may be provided. The dispensing system may comprise a control architecture internal to the dispensing system. The dispensing system may further comprise an internal portion internal to the dispensing system. The internal portion may be configured to provide an internal ingredient under the control of the control architecture. An external portion may be external to the dispensing system. The external portion may be configured to provide an external ingredient to the dispensing system. The external portion may be under the control of the control architecture.

15 Claims, 12 Drawing Sheets

(52) U.S. Cl.
CPC ..... *B65D 77/06* (2013.01); *B67D 2001/0827* (2013.01); *B67D 2210/00034* (2013.01)

(58) Field of Classification Search
USPC ..... 222/52, 129.1, 63, 105, 132, 135, 144.5, 222/145.5–145.6
See application file for complete search history.

(56) References Cited

U.S. PATENT DOCUMENTS 5,575,405 A * 11/1996 Stratton ..... B67D 1/0021 222/1
5,890,626 A * 4/1999 Wolski ..... B67D 1/0031 222/129.1
6,505,758 B2 * 1/2003 Black ..... B67D 1/0034 222/146.6
7,757,896 B2 * 7/2010 Carpenter ..... B67D 1/006 222/129.4
8,463,447 B2 * 6/2013 Newman ..... B67D 1/0021 700/283
8,584,900 B2 * 11/2013 Metropulos ..... B67D 1/0041 222/129.1
8,985,396 B2 * 3/2015 Jersey ..... B67D 1/0041 222/129.1
2002/0005413 A1 * 1/2002 Black ..... B67D 1/0067 222/146.6
2007/0012639 A1 * 1/2007 Bixler ..... B67D 1/0892 211/189
2008/0314926 A1 * 12/2008 Kumar ..... B67D 1/0021 222/129.1
2009/0069947 A1 * 3/2009 Newman ..... B67D 1/0888 700/281
2011/0301768 A1 12/2011 Hammonds et al.
2012/0298692 A1 * 11/2012 Jersey ..... B67D 1/0016 222/129.1
2014/0220184 A1 8/2014 Boggs et al.
2014/0263454 A1 9/2014 Connerat et al.
2015/0097001 A1 * 4/2015 Gatipon ..... B67D 1/0857 222/108
2015/0158712 A1 6/2015 Jersay et al.
2016/0009539 A1 * 1/2016 Jersey ..... B67D 1/0021 222/460
2016/0325980 A1 * 11/2016 Sawhney ..... G06Q 30/06
2017/0050156 A1 * 2/2017 Ziesel ..... B67D 1/0078
2017/0088410 A1 * 3/2017 Wing ..... B67D 1/0022
2017/0190558 A1 * 7/2017 Ubidia ..... G05D 7/0682
2018/0215604 A1 * 8/2018 Rudick ..... B67D 1/0021
2019/0330043 A1 * 10/2019 Carpenter ..... B67D 1/122
2020/0109042 A1 * 4/2020 Jacobsen ..... A47J 31/521

* cited by examiner

NNS Connector

Conxall/Switchcraft 7281-4SG-300

| Wiring Table | | | | | |
|---|---|---|---|---|---|
| Conn A Pin # | Conn B Pin # | Signal | Wire Note 3 | Color | Notes |
| 1 | 1 | CAN H | 20 AWG | Blue | 5 |
| 2 | 4 | CAN L | 20 AWG | White | |
| 3 | 3 | 28V RET | 16 AWG | Black | |
| 4 | 2 | 28V DC | 16 AWG | Red | |

CGP Connector

Conxall/Switchcraft 7281-7SG-300
(Receptical)

FS7000 Connector

Conxall/Switchcraft 7281-8PG-300
(Plug)

MODULAR SYSTEM FOR DISPENSING ADDITIONAL INGREDIENTS

This application is being filed on 28 Jul. 2016, as a PCT International patent application and claims priority to U.S. Provisional Patent Application Ser. No. 62/198,498, filed Jul. 29, 2016, the entire disclosure of which is incorporated by reference in its entirety.

BACKGROUND

A beverage dispenser is a device that dispenses carbonated soft drinks called fountain drinks. They may be found in restaurants, concession stands, and other locations such as convenience stores. A beverage dispenser combines flavored syrup or syrup concentrate and carbon dioxide with chilled water to make soft drinks. The syrup may be pumped from a special container called a bag-in-box (BIB).

SUMMARY

This Summary is provided to introduce a selection of concepts in a simplified form that may be further described below in the Detailed Description. This Summary is not intended to be used to limit the scope of the claimed subject matter.

A dispensing system may be provided. The dispensing system may comprise a control architecture internal to the dispensing system. The dispensing system may further comprise an internal portion internal to the dispensing system. The internal portion may be configured to provide an internal ingredient under the control of the control architecture. An external portion may be external to the dispensing system. The external portion may be configured to provide an external ingredient to the dispensing system. The external portion may be under the control of the control architecture.

BRIEF DESCRIPTION OF THE DRAWINGS

The accompanying drawings, which are incorporated in and constitute a part of this disclosure, illustrate various embodiments of the present disclosure. In the drawings.

DETAILED DESCRIPTION

Figure 1:
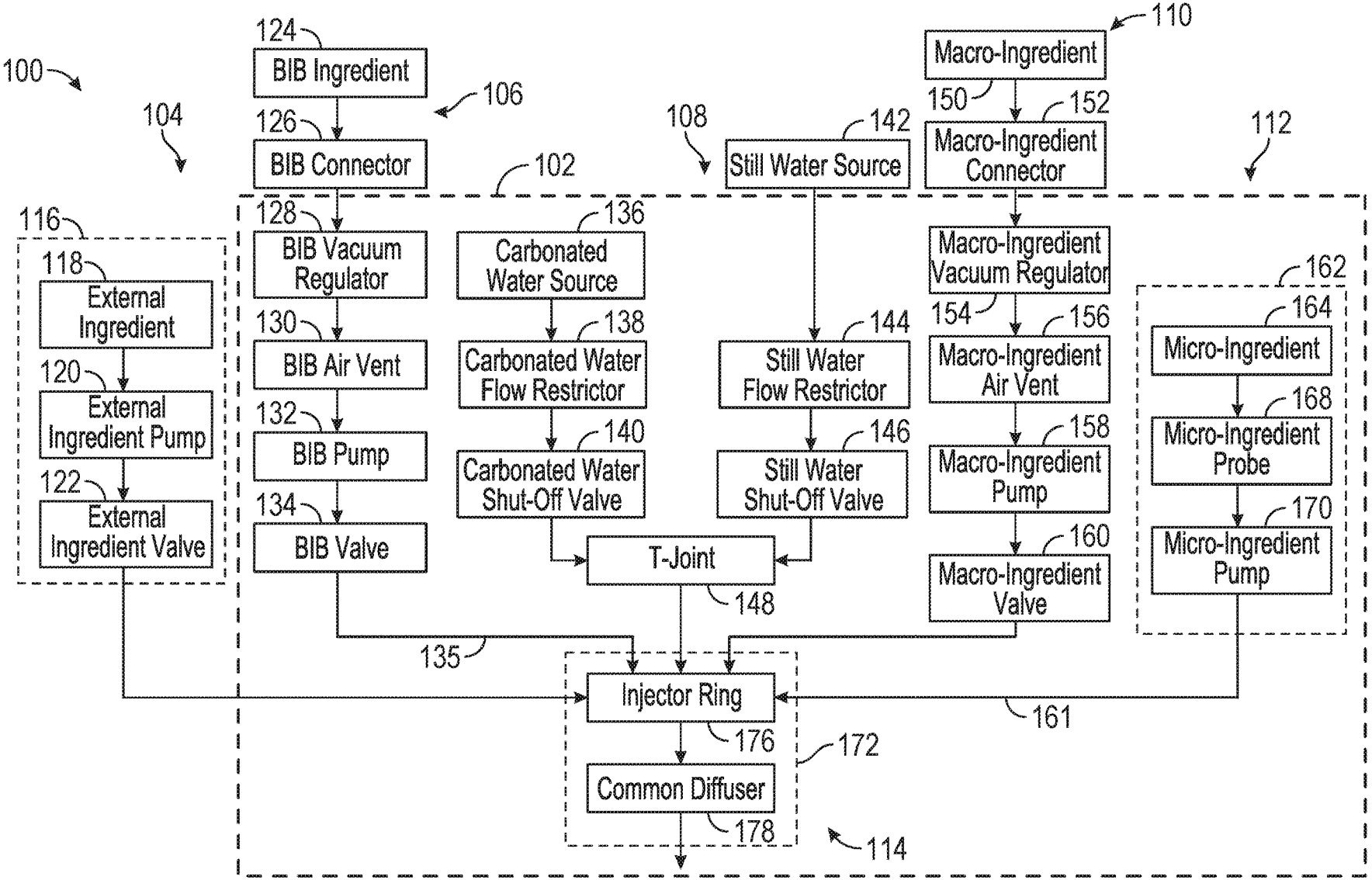
FIG. 1 shows an operating environment including a dispensing system.

The following detailed description refers to the accompanying drawings. Wherever possible, the same reference numbers are used in the drawings and the following description to refer to the same or similar elements. While embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims.

The term "beverage," as used herein, includes, but is not limited to, pulp and pulp-free citrus and non-citrus fruit juices, fruit drink, vegetable juice, vegetable drink, milk, soy milk, protein drink, soy-enhanced drink, tea, water, isotonic drink, vitamin-enhanced water, soft drink, flavored water, energy drink, coffee, smoothies, yogurt drinks, hot chocolate and combinations thereof. The beverage may also be carbonated or non-carbonated. The beverage may comprise beverage components (e.g., beverage bases, colorants, flavorants, and additives).

The term "beverage base" refers to parts of the beverage or the beverage itself prior to additional colorants, additional flavorants, and/or additional additives. According to certain embodiments of the present inventions, beverage bases may include, but are not limited to syrups, concentrates, and the like that may be mixed with a diluent such as still or carbonated water or other diluent to form a beverage. The beverage bases may have reconstitution ratios of about 3:1 to about 6:1 or higher. According to certain embodiments, beverage bases may comprise a mixture of beverage base components.

The term "beverage base component" refers to components which may be included in beverage bases. According to certain embodiments of the present inventions, the beverage base component may comprise parts of beverages which may be considered food items by themselves. According to certain embodiments of the present inventions, the beverage base components may be micro-ingredients such as an acid portion of a beverage base, an acid-degradable and/or non-acid portion of a beverage base, natural and artificial flavors, flavor additives, natural and artificial colors, nutritive or non-nutritive natural or artificial sweeteners, additives for controlling tartness (e.g., citric acid or potassium citrate), functional additives such as vitamins, minerals, or herbal extracts, nutraceuticals, or medicaments. The micro-ingredients may have reconstitution ratios from about 10:1, 20:1, 30:1, or higher with many having reconstitution ratios of 50:1 to 300:1. The viscosities of the micro-ingredients may range from about 1 to about 100 centipoise.

Thus, for the purposes of requesting, selecting, or dispensing a beverage base, a beverage base formed from separately stored beverage base components may be equivalent to a separately stored beverage base. For the purposes of requesting, selecting or dispensing a beverage, a beverage formed from separately stored beverage components may be equivalent to a separately stored beverage.

By "separately stored" it is meant that the components of the present inventions are kept separate until combined. For instance, the components may be separately stored individually in a container or package or instead may be all stored in one container or package wherein each component is individually packaged (e.g., plastic bags) so that they do not blend while in the container or package. In some embodiments, the container or package, itself, may be individual, adjacent to, or attached to another container or package.

The product ingredients may include beverage bases or beverage base components (e.g., concentrated syrups) as well as flavors (i.e., flavoring agents, flavor concentrates, or flavor syrups), which may be separately stored or otherwise contained in individual removable containers. In accordance with one or more embodiments, each of the beverage bases or beverage base components and each of the flavors may be separately stored or otherwise contained in individual removable containers, cartridges, packages or the like which may generally be referred to simply as a "package" or "ingredients package" with one or more applicable reference numbers.

FIG. 1 shows an operating environment 100 including a dispensing system 102. As shown in FIG. 1, operating environment 100 may comprise an external portion 104 and an internal portion. The internal portion may comprise a bag-in-a-box (BIB) portion 106, a water portion 108, a macro-ingredient portion 110, a micro-ingredient portion 112, and a nozzle portion 114. Flexible tubing may connect the elements of operating environment 100 in order to move ingredients and diluent (e.g. water) from element to element in operating environment 100. External portion 104, bag-in-a-box (BIB) portion 106, macro-ingredient portion 110, and micro-ingredient portion 112 may comprise ingredient sources. Water portion 108 may comprise a diluent source. Some elements (e.g. ingredients and dilute) of, BIB portion 106, water portion 108, and macro-ingredient portion 110 may be located inside of or outside of dispensing system 102.

External portion 104 may comprise a tray 116, an external ingredient 118, an external ingredient pump 120, and an external ingredient valve 122. In some embodiments, external ingredient pump 120 may be a positive displacement pump for metering a predetermined volume of a fluid for each cycle of the pump. The positive displacement pump may be a controlled gear pump, a vibratory piston pump, a screw pump, a peristaltic pump, or other such pumps suitable for metering a predetermined volume of fluid for each cycle of the pump. In such embodiments where external ingredient pump 120 is a positive displacement pump, external ingredient valve 122 may be omitted. In some embodiments, external ingredient valve 122 may be located within dispensing system 102 proximate to the nozzle. External ingredient valve 122 may be any appropriate valve for metering a desired flow rate of ingredient from the nozzle, such as a volumetric valve, a variable orifice valve, a shutoff valve in cooperation with a flow restrictor or flow control module, or the like.

Tray 116 may be temperature controlled or external ingredient 118 may be temperature controlled prior to being dispensed from nozzle assembly 172. For example, tray 116 may be located within a cold vault or other temperature controlled environment for maintaining the temperature of external ingredient 118. In such embodiments, the supply line from the tray to nozzle assembly 172 may be insulated to maintain the temperature of the ingredient as it travels to nozzle assembly 172. In some embodiments, the insulate tubing may include a recirculation loop from the temperature controlled environment to nozzle assembly 172. As another example, a heat exchanger (not shown) may be arranged between tray 116 and nozzle assembly 172 to moderate the temperature of supplied external ingredient 118. For example, external ingredient 118 may be pumped through a cold plate, a cold water bath, or other such heat exchanger to cool the external ingredient prior to nozzle assembly 172. External ingredient 118 may comprise a macro-ingredient with a reconstitution ratio of about 3:1 to about 6:1 or higher, but generally less than about 10:1 and may include insoluble particulates. For example, external ingredient 118 may comprise, but is not limited to, a sweetener comprising, for example, high fructose corn syrup (HFCS), a shelf stable juice concentrate, such as apple juice concentrate, a tea concentrate, a shelf stable dairy concentrate, an enhanced water concentrate, and the like, for example. In embodiments where external ingredient 118 is temperature controlled from tray 116 to nozzle assembly 172, additional aseptic or non-preserved juice, tea, or dairy concentrates may be used. Other sweeteners or sweetener blends may be used. External ingredient 118 may comprise a micro-ingredient with a reconstitution ratio of about 10:1 or higher, but generally 20:1 or higher, including 50:1, 75:1, 150:1, 300:1 or higher. For example, external ingredient 118 may comprise a non-nutritive sweetener, such as aspartame, with a reconstitution ratio of about 50:1 or higher. Where external ingredient 118 is a micro-ingredient, more than one external ingredient pump 120 may supply the external ingredient to nozzle assembly 172. FIG. 1 shows one external portion 104; however, one or more external portions may be used in dispensing system 102.

External ingredient pump 120 may comprise, but is not limited to, a controlled gear pump (CGP) or other suitable positive displacement pump. External ingredient valve 122 may comprise, but is not limited to, either a volumetric valve or an on/off solenoid valve. If external ingredient pump 120 is a controlled gear pump or other positive displacement pump, then external ingredient valve 122 may be a solenoid valve or may not be present. If external ingredient valve 122 is a volumetric valve, then a non-volumetric pump may be used. An example of a non-volumetric pump is a $CO_2$ powered on-demand pump. Examples of a volumetric valve are described in U.S. Pat. No. 5,381,926, Beverage Dispenser Value and Method, filed May 12, 1993, the entirety of which is hereby incorporated by reference. BIB portion 106 may comprise a BIB ingredient 124, a BIB connector 126, a BIB vacuum regulator 128, a BIB air vent 130, a BIB pump 132, and a BIB valve 134. BIB pump 132 may comprise, but is not limited to, a controlled gear pump. BIB valve 134 may comprise, but is not limited to, either a volumetric valve or an on/off solenoid valve. However, a controlled gear pump and a volumetric valve may not be used together in the same system. If BIB pump 132 comprises a controlled gear pump, then BIB value 134 may be a solenoid valve. If BIB value 134 is a volumetric valve, then a non-volumetric pump (e.g. BIB pump 132) may be used between BIB connector 126 and BIB vacuum regulator 128. An example of a non-volumetric pump is a $CO_2$ powered on-demand pump. Examples of a volumetric valve are described in U.S. Pat. No. 5,381,926, Beverage Dispenser Value and Method, filed May 12, 1993, the entirety of which is hereby incorporated by reference. Examples of a vacuum side air vent are described in PCT Patent Application Serial No. PCT/US15/028559, entitled Vacuum Side Air Vent, filed on Apr. 30, 2015, the entirety of which is hereby incorporated by reference. While FIG. 1 shows one BIB portion 106, dispensing system 102 may include one or more BIB portions including a plurality of BIB ingredients. BIB ingredients may comprise, but are not limited to beverage bases, syrups, concentrates, and the like that may be mixed with a diluent such as still or carbonated water or other diluent to form a beverage. The BIB ingredients may have reconstitution ratios of about 3:1 to about 6:1 or higher.

While embodiments shown in FIG. 1 show BIB ingredient 124 and BIB connector 126 being outside dispensing system 102 either or both BIB ingredient 124 and BIB connector 126 may be inside or outside dispensing system 102. For example, BIB ingredient 124 may be in a back room remote from dispensing system 102. If BIB ingredient 124 is near or within dispensing system 102, then suction from BIB pump 132 may draw BIB ingredient 124 and BIB vacuum regulator 128 may not be needed. If BIB ingredient 124 is not near or not within dispensing system 102, then BIB ingredient 124 may need to be pumped to dispensing system 102 under pressure and BIB vacuum regulator 128 may be needed. FIG. 1 shows one BIB portion 106 with one BIB ingredient 124; however, one or more BIB portion 106 may be used in dispensing system 102 with each BIB portion 106 having one or more BIB ingredient 124.

Water portion 108 may provide a diluent for dispensing system 102. The diluent may comprise, but is not limited to carbonated water or still water for example. Water portion 108 may comprise a carbonated water section and a still water section. The carbonated water section may comprise a carbonated water source 136, a carbonated water flow restrictor 138, and a carbonated water shutoff valve 140. In addition, the still water section may comprise a still water source 142, a still water flow restrictor 144, and a still water shutoff valve 146. The carbonated water section and the still water section may join at a T-joint 148. While embodiments shown in FIG. 1 show still water source 142 being outside dispensing system 102, still water source 142 may be inside or outside dispensing system 102.

The carbonated water section of water portion 108 may use a carbonator that receives $CO_2$ from a $CO_2$ source and dissolves the $CO_2$ in water to create carbonated water. The $CO_2$ source may comprise a $CO_2$ tank stored remotely (e.g., in a back room) with gas lines to carbonated water source 136. The ratio of $CO_2$ to still water in the carbonated water used in dispensing system 102 may be, for example, approximately 4:1 or 3:1.

Macro-ingredient portion 110 may comprise a macro-ingredient 150, a macro-ingredient connector 152, a macro-ingredient vacuum regulator 154, a macro-ingredient air vent 156, a macro-ingredient pump 158, and a macro-ingredient valve 160. Macro-ingredient pump 158 may comprise, but is not limited to, a controlled gear pump. Macro-ingredient valve 160 may comprise, but is not limited to, a volumetric valve. As explained above, a controlled gear pump and a volumetric valve may not be used together in the same system. If a controlled gear pump is used, then macro-ingredient valve 160 may comprise a solenoid value. If macro-ingredient valve 160 is a volumetric valve, then a non-volumetric pump may be used between connector 152 and vacuum regulator 154. Examples of a volumetric valve are described in U.S. Pat. No. 5,381,926, Beverage Dispenser Value and Method, filed May 12, 1993. Macro-ingredient 150 may comprise, but is not limited to, a sweetener comprising, for example, high fructose corn syrup (HFCS) for example. Other sweeteners or sweetener blends may be used. Macro-ingredient 150 may have reconstitution ratios of about 3:1 to about 6:1 or higher, but generally less than about 10:1.

While embodiments shown in FIG. 1 show macro-ingredient 150 and macro-ingredient connector 152 being outside dispensing system 102, either or both macro-ingredient 150 and macro-ingredient connector 152 may be inside or outside dispensing system 102. For example, macro-ingredient 150 may be in a back room remote from dispensing system 102. If macro-ingredient 150 is near or within dispensing system 102, then suction from macro-ingredient pump 158 may draw macro-ingredient 150 and macro-ingredient vacuum regulator 154 may not be needed. If macro-ingredient 150 is not near or not within dispensing system 102, then macro-ingredient 150 may need to be pumped to dispensing system 102 under pressure and macro-ingredient vacuum regulator 154 may be needed. FIG. 1 shows one macro-ingredient portion 110 with one macro-ingredient 150; however, one or more macro-ingredient portion 110 may be used in dispensing system 102 with each macro-ingredient portion 110 having one or more macro-ingredient 150.

Macro-ingredients can come in a variety of containers and in various amounts. As noted, the macro-ingredients can be delivered in BIB containers or, alternatively, in tanks, drums, buckets, etc. The macro-ingredients can be delivered in quantities ranging from less than a gallon to large quantities exceeding 50 to 75 gallons. In another example, one or more cleaning products (e.g., sanitizer) can be automatically supplied from a container, such as a bucket, to the dispensing system 102 during a periodic cleaning cycle performed by the dispensing system 102.

The macro-ingredients can be stored at ambient temperature and delivered at ambient or chilled to the dispenser. In other examples, the macro-ingredients can be stored and delivered at pre-chilled temperatures. Many configurations are possible.

Micro-ingredient portion 112 may comprise a micro-ingredient tower 162. Micro-ingredient tower 162 may comprise a micro-ingredient 164, a micro-ingredient probe 168, and a micro-ingredient pump 170. Micro-ingredient pump 170 may comprise, but is not limited to, a piston pump.

FIG. 1 shows micro-ingredient tower 162 having one micro-ingredient 164; however, micro-ingredient tower 162 may include one or more micro-ingredients 164. Micro-ingredient 164 may be packaged in a micro-ingredient package. Any number of micro-ingredient packages may be included in dispensing system 102 depending, for example, on the capacity of dispensing system 102. Examples of micro-ingredient packages are described in U.S. patent application Ser. No. 14/209,684, Beverage Dispenser Container and Carton, filed Mar. 13, 2014, the entirety of which is hereby incorporated by reference.

Nozzle portion 114 may comprise a dispensing nozzle assembly. Dispensing nozzle assembly 172 may comprise an injector ring 176 and a common diffuser 178. Examples of dispensing nozzle assembly 172 may be described in U.S. patent application Ser. No. 14/265,632, the entirety of which is hereby incorporated by reference. Dispensing nozzle assembly 172 may combine the flows from the plurality of pumps and/or valves in dispensing system 102 (e.g., external ingredient pump 120, external ingredient valve 122, BIB pump 132, BIB valve 134, carbonated water shutoff valve 140, still water shutoff valve 146, macro-ingredient pump 158, macro-ingredient valve 160, and micro-ingredient pump 170) to mix and dispense a product (e.g. a beverage) into a container (e.g. a cup). The product mixing may occur prior to, during, and/or following dispense of the flows from dispensing nozzle assembly 172. Dispensing to, during, and or/following dispense of the flows may be generally and collectively referred to as dispensing about dispensing nozzle assembly 172 and may be within or proximate to the container suitable to hold the product.

At injector ring 176, diluent (e.g. water) from water portion 108 may come together with one or more ingredients from external portion 104, BIB portion 106, macro-ingredient portion 110, and micro-ingredient portion 112 into a flow from the bottom of common diffuser 178. The flow coming from common diffuser 178 may contain: i) only diluent from water portion 108; ii) one or more ingredients released from external portion 104, BIB portion 106, macro-ingredient portion 110, and micro-ingredient portion 112; or iii) diluent from water portion 108 in addition to one or more ingredients released from external portion 104, BIB portion 106, macro-ingredient portion 110, and micro-ingredient portion 112.

Figure 2:
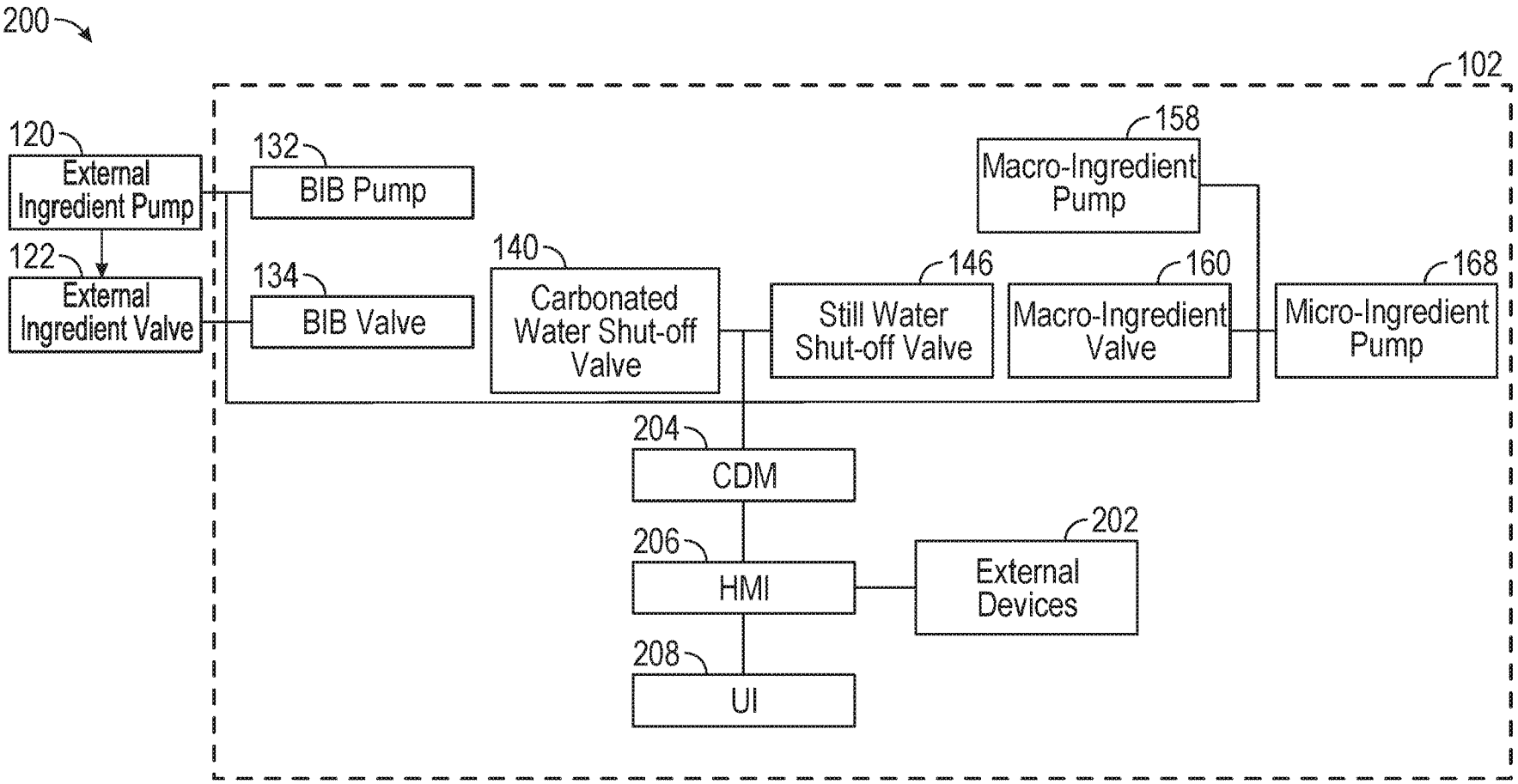
FIG. 2 shows a control architecture used to control the dispensing system.

FIG. 2 shows a control architecture 200 that may be used to control dispensing system 102. Control architecture 200 may be internal to dispensing system 102 and may control external portion 104 and the internal portion. As shown in FIG. 2, control architecture 200 may comprise a core dispense module (CDM) 204, a human machine interface (HMI) module 206, and a user interface (UI) 208. HMI module 206 may connect to or otherwise interface and communicate with at least one external device 202 being external to dispensing system 102. CDM 204 may control flows from the plurality of pumps and/or valves in operating environment 100 (e.g., external ingredient pump 120, external ingredient valve 122, BIB pump 132, BIB valve 134, carbonated water shutoff valve 140, still water shutoff valve 146, macro-ingredient pump 158, macro-ingredient valve 160, and micro-ingredient pump 170) according to a recipe to mix and dispense the product (e.g. a beverage) from dispensing system 102.

The aforementioned beverage components (i.e. beverage bases or beverage base components and flavors) may be combined, along with other ingredients, to dispense various products that may include beverages or blended beverages (i.e. finished beverage products) from the dispensing system 102. However, dispensing system 102 may also be configured to dispense beverage components individually. In some embodiments, dispensing system 102 may be configured to dispense beverage base components to form a beverage base or finished beverage. The other beverage ingredients may include diluents such as still or carbonated water, functional additives, or medicaments, for example.

An example of control architecture 200 for dispensing system 102 may be described in U.S. Patent Application Ser. No. 61/987,020, titled Dispenser Control Architecture, filed on May 1, 2014, the entirety of which is hereby incorporated by reference. A machine bus (MBUS) may facilitate communication between the HMI module 206 and the CDM 204. HMI module 206, the MBUS, and CDM 204 may collectively comprise common core components, implemented as hardware or as combination of hardware and software, which may be adapted to provide customized functionality in dispensing system 102. Dispensing system 102 may further include memory storage and a processor. Examples of UI 208 may be described in U.S. Patent Application Ser. No. 61/877,549, titled Product Categorization User Interface for a Dispensing Device, filed on Sep. 13, 2013, the entirety of which is hereby incorporated by reference. HMI module 206 and the CDM 204 may be customized through the use of adapters (e.g. configuration files comprising application programming interfaces (APIs)) to provide customized user interface views and equipment behavior for the dispensing system 102.

In some embodiments, UI 208 in dispensing system 102 may be utilized to select and individually dispense one or more beverages. The beverages may be dispensed as beverage components in a continuous pour operation whereby one or more selected beverage components continue to be dispensed while a pour input is actuated by a user or in a batch pour operation whereby a predetermined volume of one or more selected beverage components are dispensed (e.g. one ounce at a time). UI 208 may be addressed via a number of methods to select and dispense beverages. For example, a user may interact with UI 208 via touch input to navigate one or more menus from which to select and dispense a beverage. As another example, a user may type in a code using an onscreen or physical keyboard (not shown) on dispensing system 102 to navigate one or more menus from which to select and dispense a beverage.

UI 208, which may include a touch screen and a touch screen controller, may be configured to receive various commands from a user (i.e. consumer input) in the form of touch input, generate a graphics output and/or execute one or more operations with dispensing system 102 (e.g. via HMI module 206 and/or CDM 204), in response to receiving the aforementioned commands. A touch screen driver in HMI module 206 may be configured to receive the consumer or customer inputs and generate events (e.g. touch screen events) that may then be communicated through a controller to an operating system of HMI module 206.

Dispensing system 102 may be in communication with one or more external device 202. In some embodiments, the communication between dispensing system 102 and external device 202 may be accomplished utilizing any number of communication techniques including, but not limited to, near-field wireless technology such as BLUETOOTH, Wi-Fi and other wireless or wireline communication standards or technologies, via a communication interface.

External device 202 may include, for example, a mobile device, a smartphone, a tablet personal computer, a laptop computer, biometric sensors, and the like. In some embodiments, external device 202 may be utilized to receive user interface views from HMI module 206 that may be in lieu of or in addition to user interface views displayed in user interface 208 of dispensing system 102. For example, in some embodiments, dispensing system 102 may be configured for "headless" operation in which graphics and other user interface elements are displayed on a customer's smartphone instead of on dispensing system 102. Examples of facilitating interaction between a mobile computing device and an electronic device are described in U.S. Patent Application Ser. No. 61/860,634, titled Facilitating Individualized Used Interaction With An Electronic Device, filed Jul. 31, 2013, the entirety of which is hereby incorporated by reference.

Figure 3:
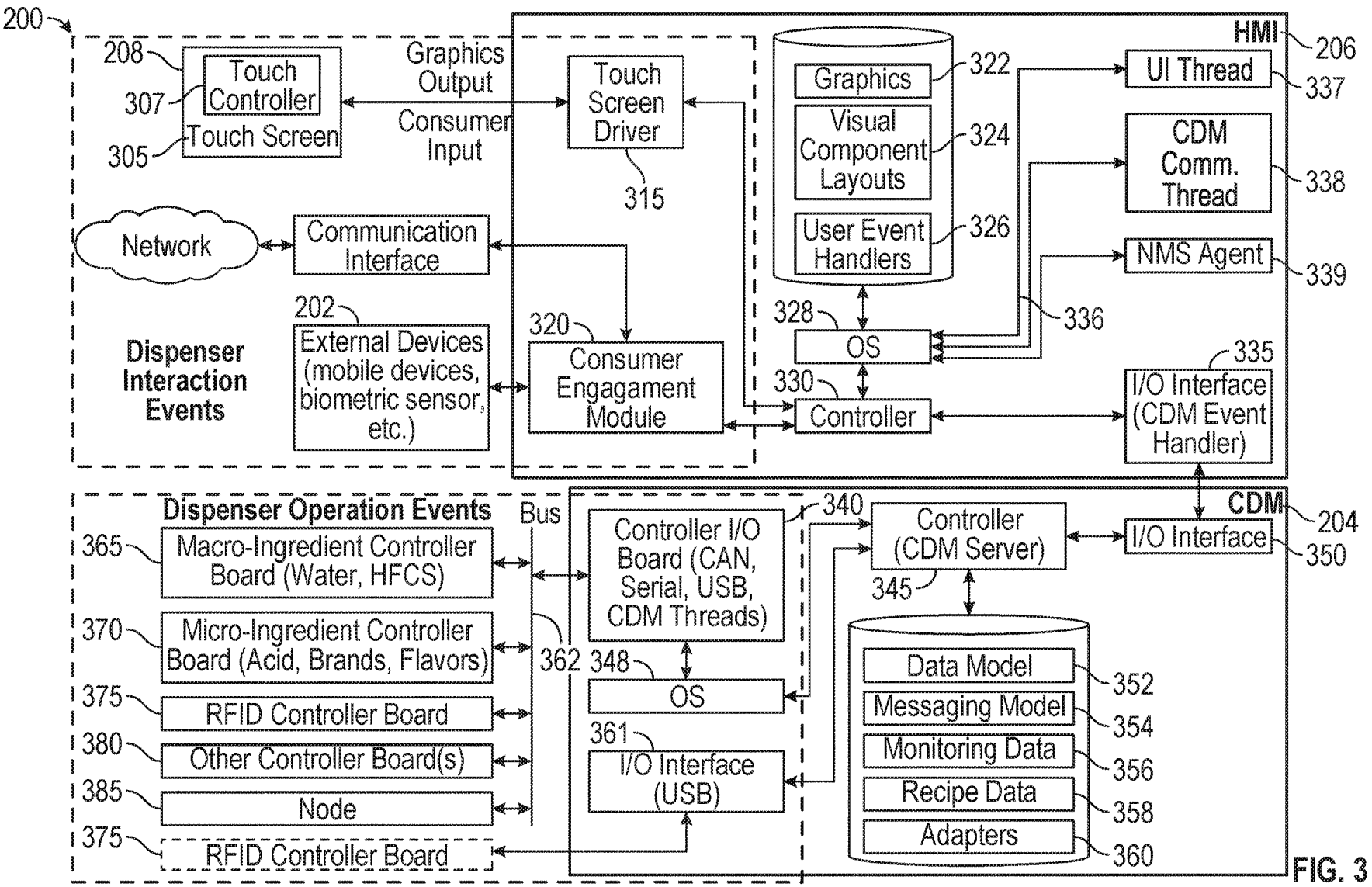
FIG. 3 shows a block diagram of the control architecture of FIG. 2 in more detail.

FIG. 3 is a block showing control architecture 200 in more detail. As shown in FIG. 3, dispensing system 102 may be configured to perform dispenser interaction events (which are handled either independently by HMI 206 or in conjunction with the CDM 204) and dispenser operation events (that may be handled either independently by the CDM 204 or in conjunction with the HMI 206). Dispensing system 102 may include a touch screen 305, a communication interface, HMI 206, CDM 204, a communications bus 362, a macro-ingredient controller board 365, a micro-ingredient controller board 370, an RFID controller board 375, other controller boards 380, and a node 385.

Touch screen 305, which may comprise a touch controller 307, may be configured to receive various commands from a user (i.e., consumer input) in the form of touch input, generate a graphics output (e.g., touch screen coordinates) and/or execute one or more operations with the dispense module (via HMI 206 and/or CDM 204), in response to receiving the aforementioned commands.

HMI 206 may include a touch screen driver 315, a consumer engagement module 320, stored graphics 322, stored visual component layouts 324, stored user event handlers 326, an operating system 328, a controller 330 and an input/output interface 335. Touch screen driver 315 may be configured to receive the consumer or customer inputs and generate events (e.g., touch screen events) that may then be communicated through controller 330 to operating system 328. For example, the touch screen events may indicate coordinates on touch screen 305 where a received touch input is detected. Operating system 328 may also be in communication with a number of threads that may include a user interface thread 337, a CDM communications thread 338, and a Network Management System (NMS) agent thread 339. In an embodiment, operating system 328 may call threads 337-339 to execute various processes, which may include graphics rendering and communication operations, in HMI 206. For example, operating system 328 may call user interface thread 337 to render graphics on touch screen 305 in response to a generated event 336, such as a touch event. In particular, user interface thread 337 may be configured to execute a function in response to events with the stored user event handlers 326 through operating system 328. For example, user interface thread 337 may execute a screen navigation function associated with the coordinates of a touch screen event. The screen navigation function may then cooperate with user event handlers 326 to select stored graphics 322 and visual component layouts 324 corresponding to the screen navigation function to render new graphics on touch screen 305.

As another example, operating system 328 may call CDM communications thread 338 to initiate the communication of events to CDM 204. The communications from the HMI 206 to CDM 204 may be enabled by a CDM event handler in input/output interface 335. As yet another example, operating system 328 may call the NMS agent thread 339 to initiate backend communications between HMI 206 and one or more backend (i.e., external) databases. In an embodiment, NMS agent thread 339 may be configured to route instructions through operating system 328, controller 330, and consumer engagement module 320 to communication interface 32 (e.g., a modem). Communication interface 22 may then forward the instructions to the databases over a network. For example, NMS agent thread 339 may be utilized to send instructions for requesting updated graphics for customizing a user interface displayed on touch screen 305.

Controller 330 in HMI 206 may also be in communication with a consumer engagement module 320. In various embodiments, consumer engagement module 320 may be configured to receive inputs (e.g., consumer commands) from external devices 202 that may be in lieu of or in addition to consumer input received from touch screen 305. Where the touch screen events relate to operations with the dispense module, controller 330 may also be in communication with input/output interface 335 which functions as an event handler for the CDM 204. In particular, input/output interface 335 may enable the communication of events (e.g., beverage pouring events) from HMI 206 to CDM 204 via corresponding input/output interface 350.

CDM 204 may include a controller input/output board 340, a controller 345, an operating system 348, input/output interface 350, a stored data model 352, a stored messaging model 354, stored monitoring data 356, stored recipe data 358, stored adapters 360, and an input/output interface 361. Controller input/output board 340 may be in communication with controller 345, operating system 348 and communications bus 362. In some embodiments, controller input/output board 340 may comprise a number of interfaces and ports for communicating various dispenser commands. The interfaces and ports may include, but are not limited to, controller area network (CAN) interfaces, serial ports (e.g., RS-232), and USB ports. The configuration of controller input/output board 340 may be based on the type of dispenser being utilized (e.g., CAN interfaces for dispensers that communicate using CAN messages, RS-232 ports for dispensers utilizing serial communications and USB ports for dispensers utilizing USB communications). For example, in some dispenser configurations, controller input/output board 340 may be operative to communicate to the RFID controller board 375 exclusively over a USB connection. In some embodiments, controller input/output board 340 may include combinations of CAN interfaces, serial ports and/or USB ports. Controller input/output board 340 may further include one or more threads (i.e., CDM threads) for communicating various dispenser commands, instructions and messages between the controller boards 365-380, node 385 and controller 345 via the operating system 348. In embodiments, the controller input/output board 340 may perform client functions in the CDM 204.

Controller 345 may be in communication with operating system 348, input/output interface 350, stored data model 352, stored messaging model 354, stored monitoring data 356, stored recipe data 358, stored adapters 360, and input/output interface 361. In embodiments, controller 345 may perform server functions in CDM 204. Controller 345 may be configured to receive CDM event communications from the input output interface 335 in HMI 206 via input/output interface 350. Controller 345 may further communicate with controller input/output board 340 or input/output interface 361 (via the operating system 348) to send and receive control or command messages for performing various dispenser operations. In some dispenser configurations, the control or command messages may be executed by the controller boards 365-380 and/or node 385 that may be in communication with controller input/output board 340 and communications bus 362. In other dispenser configurations, the control or command messages may be executed via controller boards having a direct connection to input/output interface 361. For example, in an embodiment, RFID controller board 375 may optionally be connected (via USB) directly to input/output interface 361. In some embodiments, the control or command messages may include, without limitation, monitoring a current dispenser status and dispenser events (which may be stored in monitoring data 356), generating dispenser status messages or events, retrieving a beverage product recipe (e.g., from stored recipe data 358) based on a received beverage identification, selecting a number of dispenser pumps based on ingredients in a previously retrieved beverage product recipe, starting and stopping dispenser pumps based on ratios of the ingredients in the retrieved beverage product recipe, and initiating agitation of various ingredients (e.g., ice, carbonation, etc.) associated with dispensing a beverage product.

Communications bus 362 may connect CDM 204 to macro-ingredient controller board 365, micro-ingredient controller board 370, RFID controller board 375, other controller boards 380, and node 385. In some dispenser configurations, macro and micro-ingredient controller boards 365 and 370 may not be utilized and may be replaced by an input/output module. Ingredient controller boards 365, 370 or input/output interface 361 may be utilized for pumping ingredients or otherwise controlling dispenser equipment to facilitate the dispensing of beverage products from dispensing system 102. Ingredient controller boards 365, 370 or input/output interface 361 may also be utilized to carry out periodic agitation of ingredients utilized in the dispensing of a beverage from dispensing system 102. In an embodiment, other controller boards 380 may comprise a controller board containing a door open sensor (not shown) which detects when a dispenser door has been opened and may further be configured to communicate a current dispenser door status to CDM controller input/output board 340. In some embodiments, RFID controller board 375 may be utilized for identifying beverage ingredient cartridges installed in dispensing system 102. Controller boards 365-380 may also facilitate the starting and stopping of dispenser agitation and/or pumping operations based on monitored events (e.g., the opening of a dispenser door, ingredient cartridge removal/insertion, ingredient sold out status, etc.). Node 385 may facilitate modular expansion of additional ingredient sources and associate pumps and controllers or other such additional dispenser hardware desired.

As noted, in this example, the RFID controller board 375 controls one or more RFID readers to monitor ingredient cartridge removal/insertion, etc. In other examples, other communication schemes can be used, such as one or more optical scanners that are positioned to read (e.g., using optical character recognition) information on the cartridges that are added and removed.

In some example, the system is programmed to provide one or more display screens associated with the UI 208. These display screens assist the user in identifying the ingredients inserted into and removed from the system. For example, RFID and/or optical schemes can be used to automatically identify ingredients that are interested into and removed from the dispensing system 102.

Further, the display screens can provide indications on the statuses of ingredients (e.g., location and amount) at one or more of the external portion 104, the internal portion dispenser, and/or the ingredients located in the back room. For example, the UI 208 can provide one or more "fuel gauges" that provide a visual indication to the user as to the amount of product remaining in a cartridge (e.g., "sold out" indication) which may be dispensed. Such a configuration is described in PCT Publication No. WO2015/130791, Prevention of Cartridge Reuse Through Encryption, filed Feb. 25, 2015, the entirety of which is hereby incorporated by reference. The sold out status for each ingredient can be determined using various metrics, such as ingredient weight (with a scale), amount of product dispensed, flow characteristics of the product, etc. Information associated with the ingredients used by the dispensing system 102 can be sent to a central server for the purposes of tracking use, inventory ordering and analysis, etc.

HMI 206 and CDM 204 in dispensing system 102 may comprise a control architecture that may be utilized for performing dispenser interaction events. In some embodiments, the dispenser interaction events may be initiated from a consumer, customer, technician or administrator via a user interface on dispensing system 102. In some embodiments, the dispenser interaction events may be initiated via external devices 202 (e.g., from mobile devices such as smartphones, tablets, laptop computers, etc.). In some embodiments, the dispenser interaction events may be initiated via remote external devices such as backend database servers (e.g., the databases) or other backend computing devices. The dispenser interaction events may include events which are handled independently by HMI 206 or in conjunction with CDM 204. In an embodiment, HMI 206 may independently handle screen navigation. For example, HMI 206 may receive a request to navigate between display screens on dispensing system 102 via a screen navigation touch event. User interface thread 337 may then process an event 336 (i.e., the screen navigation touch event) to reference and load the appropriate screen from stored graphics 322 and visual component layouts 324.

In another embodiment, HMI 206 may handle dispenser control events (e.g., the pouring of a beverage, etc.) in conjunction with CDM 204. For example, a request to dispense a selected beverage product on touch screen 305 (or alternatively external devices 202) may be realized by HMI 206 sending instructions to CDM 204. CDM 204 may then translate the instructions (via an adapter 360) to appropriate control messages for communication by controller input/output board 340 (via communications bus 362) to the appropriate hardware (i.e., ingredient controller boards 365 and/or 370) which may be utilized for dispensing the selected beverage product. As another example, a consumer wishing to select a beverage product for dispense may interact with touch screen 305 to request a menu of available beverages for selection. In response to the consumer interaction, the consumer input may be communicated to HMI 206 as an event 336 to touch screen driver 315 and subsequently communicated to operating system 328 (via controller 330) for processing by user interface thread 337. CDM communications thread application 338 may then be configured to send event 336 (i.e., instructions) to CDM 204 which, utilizing adapter 360, may translate the instructions to predetermined commands (i.e., dispenser-specific control messages compatible with the type of dispenser and associated underlying equipment hardware being utilized) for performing requested operations received in event 336. As another example, a request to display a menu that includes data or settings related to specific hardware in dispensing system 102 via touch screen 305 (or external device 202), may be realized by the HMI 206 sending instructions to CDM 204 that may translate the instructions and communicate control messages and/or data back to HMI 206 to retrieve stored graphics 322 and visual component layouts 324 (which are specific to a particular dispenser display) for output on touch screen 305. As still another example, a request to control a dispenser lighting function (e.g., background lighting) on touch screen 305 may be realized by HMI 206 sending instructions to CDM 204 that may translate the instructions (via adapter 360) and communicate one or more command messages for controlling dispenser lighting.

HMI 206 and CDM 204 in dispensing system 102 may comprise a control architecture that may also be utilized for performing dispenser operation events. In some embodiments, the dispenser operation events may include dispenser controller board sensor events (e.g., pump operation status, dispenser door open, etc.), dispenser monitored data (e.g., empty ingredients) and dispenser background processes (e.g., dispenser agitation). The dispenser operation events may include events which are handled independently by CDM 204 (e.g., dispenser background processes) or in conjunction with HMI 206. Dispenser operation events which may be handled by CDM 204 in conjunction with HMI 206 may include the updating of a dispenser display screen/graphics in response to a change in a dispenser operation status (e.g., the dispenser is out of one or more ingredients, the dispenser door is open, the dispenser is dispensing a beverage for a consumer, etc.).

Figure 4:
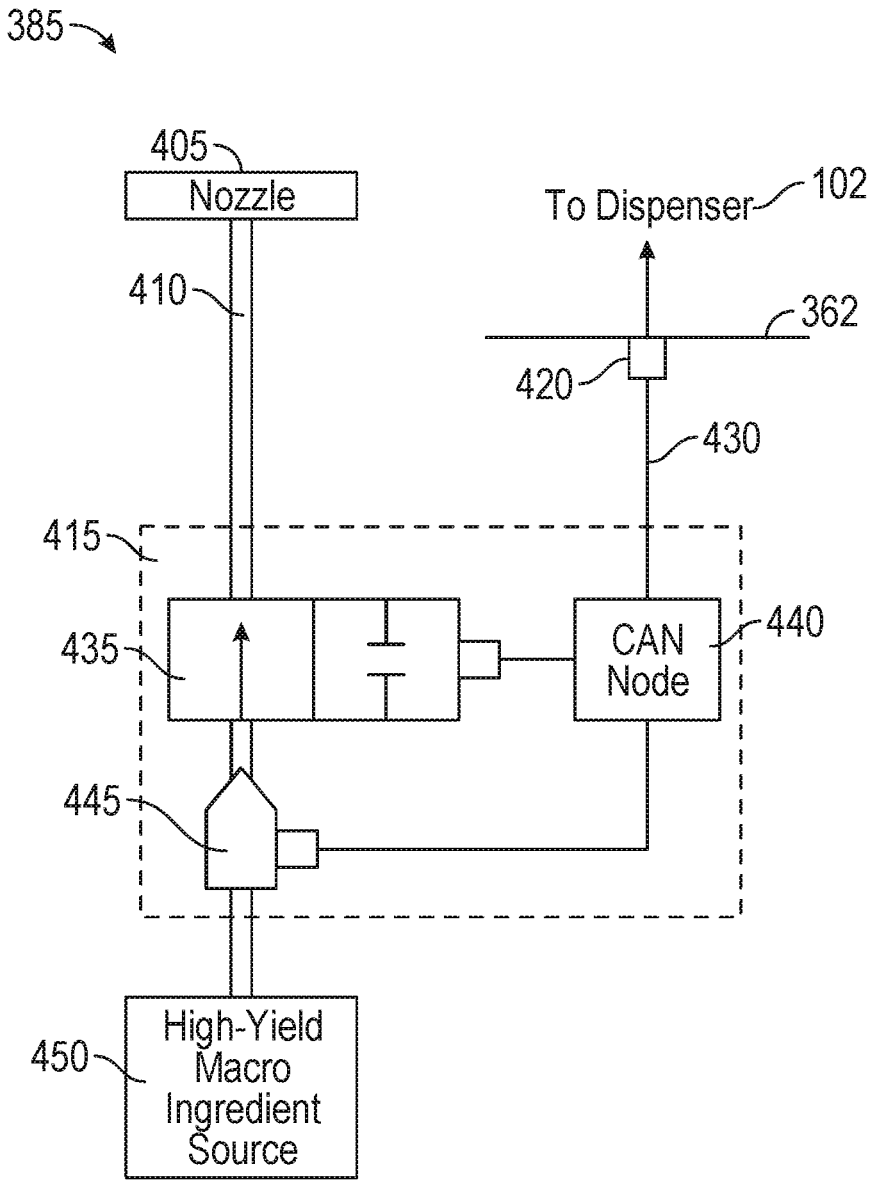
FIG. 4 is a block diagram showing a modular add-on for the control architecture of FIG. 2 and FIG. 3.

FIG. 4 shows node 385 of dispensing system 102's control architecture 200 in more detail. Node 385 may comprise a modular device that may be added (e.g., retrofitted) to dispensing system 102 utilizing above-described dispenser control architecture 200. For example, node 385 may comprise external portion 104.

In an embodiment, node 385 may be utilized for dispensing high-yield (e.g., 8:1 to 15:1 reconstitution ratio) macro-ingredients or alternative sweetener macro-ingredients such as sweetener blends or non-nutritive sweeteners (NNS). Node 385 may include a nozzle 405 (e.g. dispensing nozzle assembly 172), tubing 410, a pumping module enclosure 415, a removable electrical connector 420 (for connecting node 385 to dispensing system 102 via the communications bus 362), an electrical connection 430 and a high-yield macro-ingredient source 450 or other such additional desired beverage ingredient. In some embodiments, nozzle 405 may already be present on dispensing system 102 and may not be included as part of node 385.

Nozzle 405 may be in fluidic communication with tubing 410 and utilized for dispensing the high-yield macro-ingredient source 450 which, in some embodiments, may comprise one or more ingredients having a reconstitution ratio of about 6:1 to about 10:1. In some embodiments, high-yield macro-ingredient source 450 may have a reconstitution ratio of about 8:1 to about 15:1. Tubing 410 may also be in fluidic communication with a pumping module enclosure 415. Pumping module enclosure 415 may be in fluidic communication with high-yield macro-ingredient source 450 and electrically connected to removable connector 420 via electrical connection 430. In some embodiments, tubing 410 and electrical connection 430 may be bundled into a single electrical/fluidic harness connecting nozzle 405, pumping module enclosure 415, removable connector 420 and high-yield macro-ingredient source 450.

Pumping module enclosure 415 may include a solenoid valve 435, a CAN node 440, and a pumping/metering device 445. In an embodiment, pumping module enclosure 415 may be located near dispensing system 102 (e.g., under a counter). In some embodiments, high-yield macro-ingredient source 450 may comprise multiple macro-ingredient sources connected to a corresponding number of pumping/metering devices 445 and a corresponding number of CAN nodes 440 in pumping module enclosure 415.

Pumping/metering device 445 (which may comprise a controlled gear pump) may be connected to high-yield macro-ingredient source 450 and further be in fluid communication with solenoid valve 435. Solenoid valve 435 may be utilized to prevent fluid from drooling at the nozzle 405. Pumping/metering device 445 may be controlled by CAN node 440 which may be removably connected to dispensing system 102 (via the removable connector 420 and the bus 362). Thus, node 385 may be added to dispensing system 102 by utilizing removable connector 420 to CAN node 440. In an embodiment, CAN node 440 may be connected to controller input/output board 340 in dispensing system 102 (via the communications bus 362). Pumping/metering device 445, in communication with CAN node 440, may turn the flow of macro-ingredients (from high-yield macro-ingredient source 450) on an off in coordination with the flow of other ingredients and diluents at nozzle 405 based on the recipe corresponding to the selected beverage. The macro-ingredients may then be air-mixed into the main stream from the nozzle. In an embodiment, the high-yield macro-ingredient source may comprise one or more bags-in-boxes (BIBs).

Controller input/output board 340 may be configured to recognize the node 385 via a software update to adapters 360 stored in CDM 204 of dispensing system 102. The addition of node 385 may also comprise additional updates being made to backend databases in communication with dispensing system 102 to utilize new beverage recipes and associated dispenser display screen graphics associated with the macro-ingredients pumped from high-yield macro-ingredient source 450. For example, images/icons and recipe data in the databases may be updated to reflect new beverage recipes and associated graphics which may be selected on dispensing system 102 via touch screen 305. The recipe and graphics data may be accessed by HMI 206 (e.g., utilizing NMS agent thread 339). HMI 206 may then utilize user interface thread 337 to communicate the new graphics to touch screen 305 and/or the external devices 202. HMI 206 may further utilize CDM communications thread 238 to communicate the updated recipe data to CDM 204 to facilitate the dispensing of beverages with one or more new ingredients.

Figure 5A:
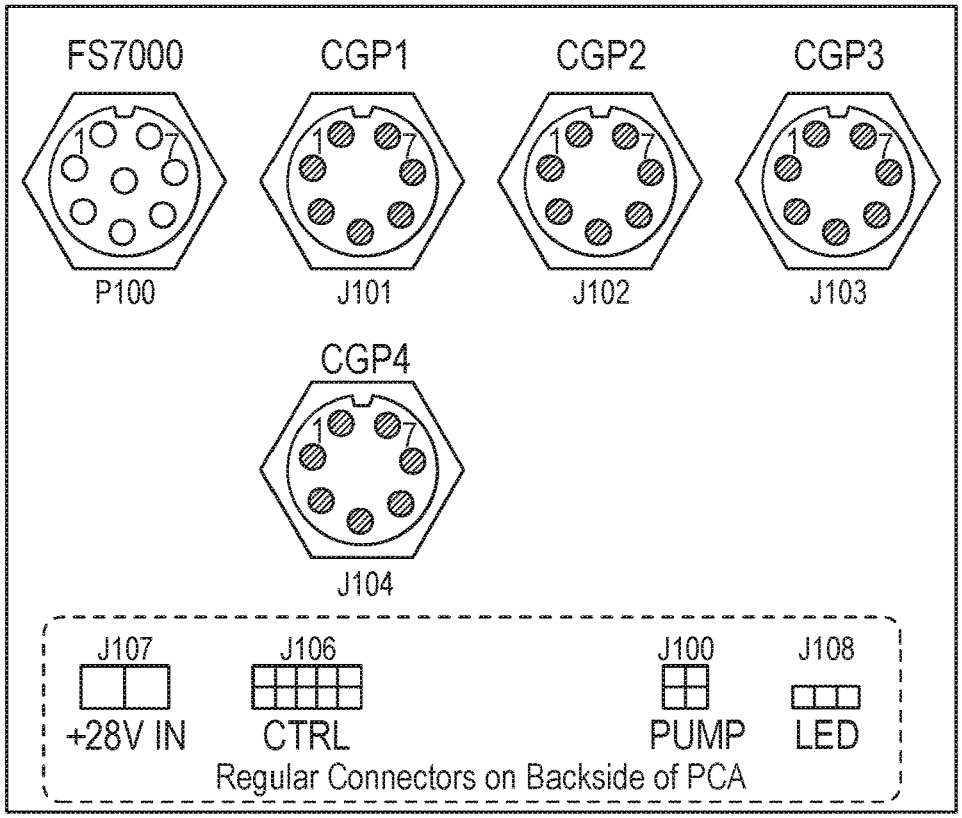
FIG. 5A, FIG. 5B, FIG. 5C, and FIG. 5D show connector layouts for a printed circuit assembly (PCA) for a modular add-on component.
Figure 5B:
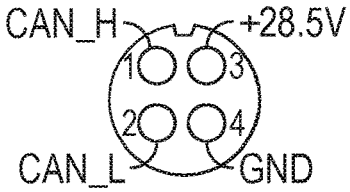
Figure 5C:
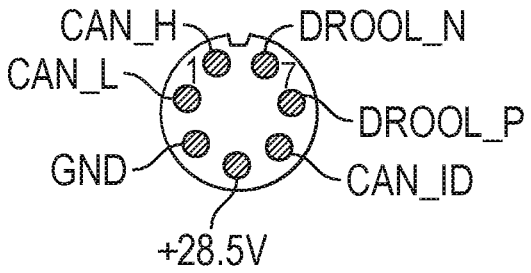
Figure 5D:
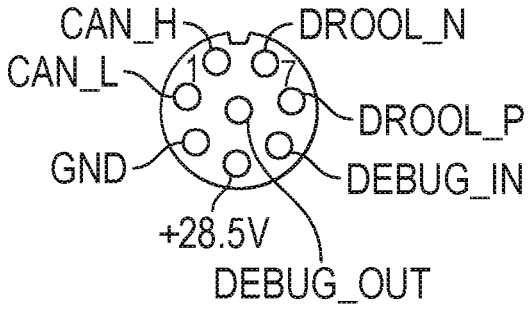
Figure 6A:
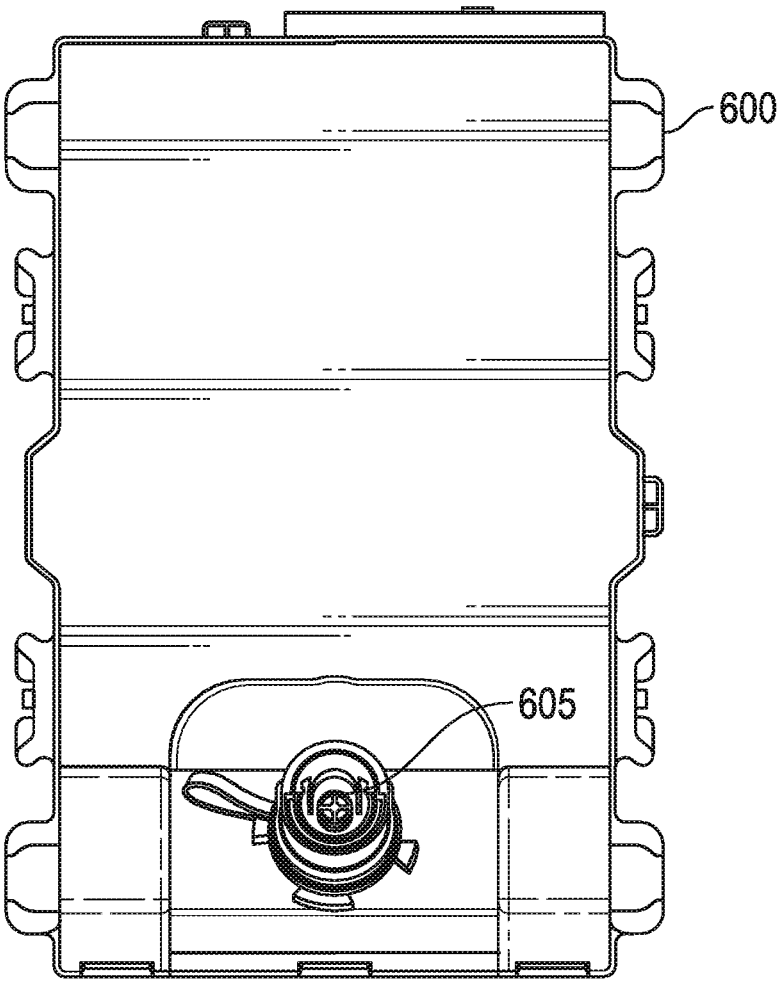
FIG. 6A, FIG. 6B, FIG. 6C, FIG. 6D, FIG. 6E, and FIG. 6F show a primary tray.
Figure 6B:
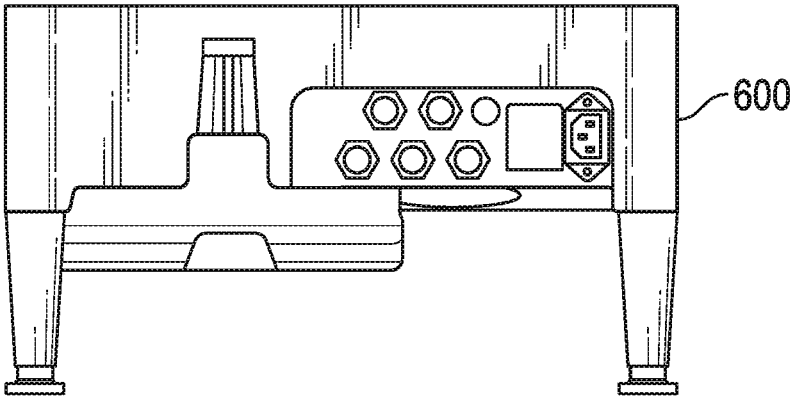
Figure 6C:
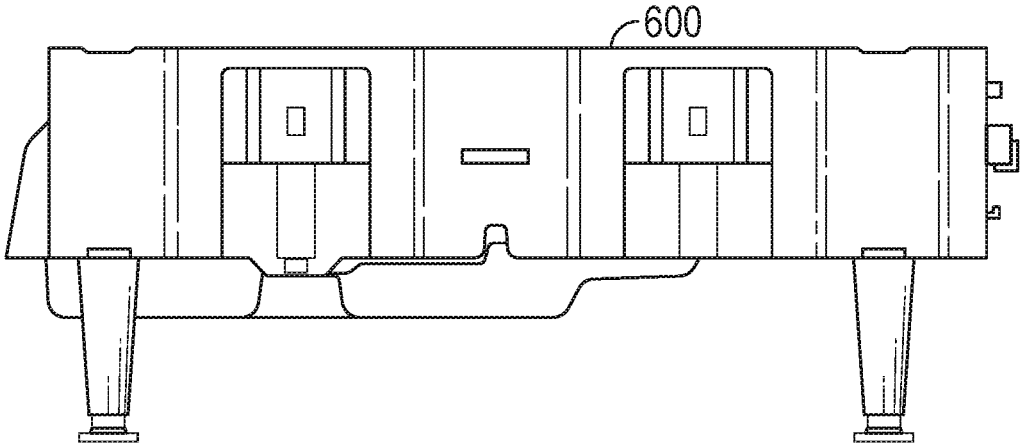
Figure 6D:
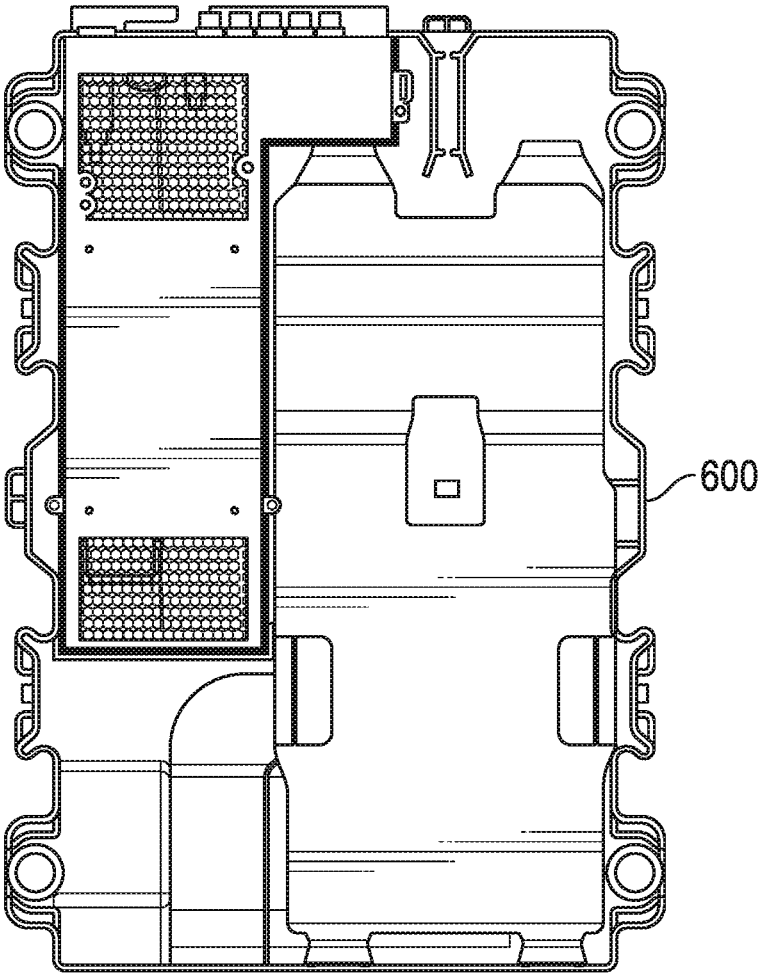
Figure 6E:
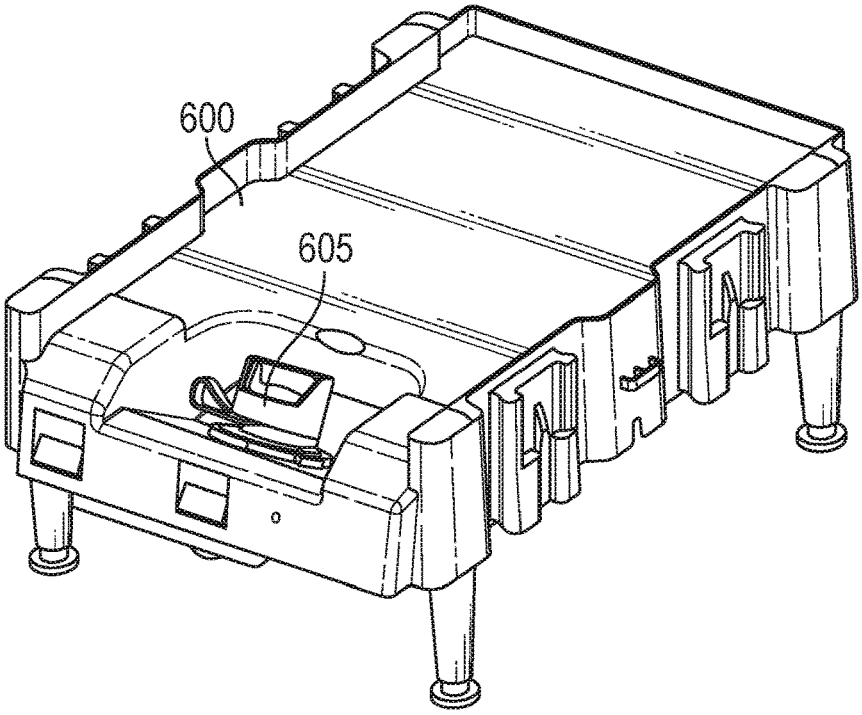
Figure 6F:
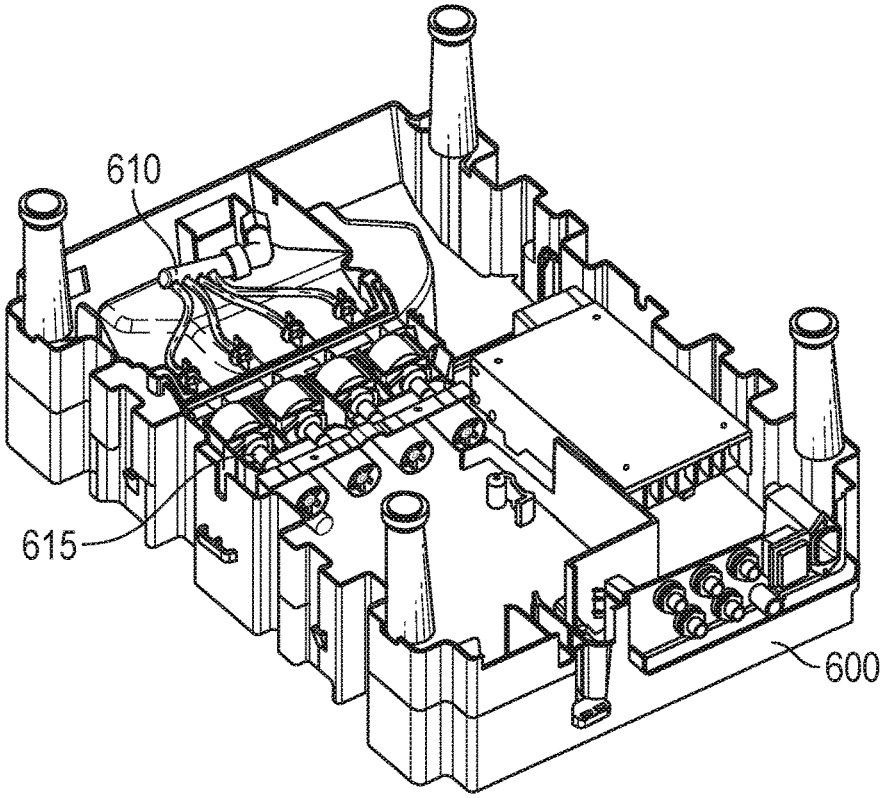

FIG. 5A shows an example of CAN connector layout for a printed circuit assembly (PCA) for the tray 116. As shown in FIG. 6B, the CAN connectors may be located on the back of a primary tray 600, described in more detail below. The CAN connectors may include a primary connector FS7000 for connecting the tray 600 to the CDM 204 of dispensing system 102 via communications bus 362. The CAN connector layout also shows further CAN connectors CGP1-CGP4 for connecting to additional modular external ingredients 118 as described in more detail in FIGS. 8A and 8B below. FIGS. 5B-5D shown exemplary pin assignments for each of the CAN connectors.

Figure 5E:
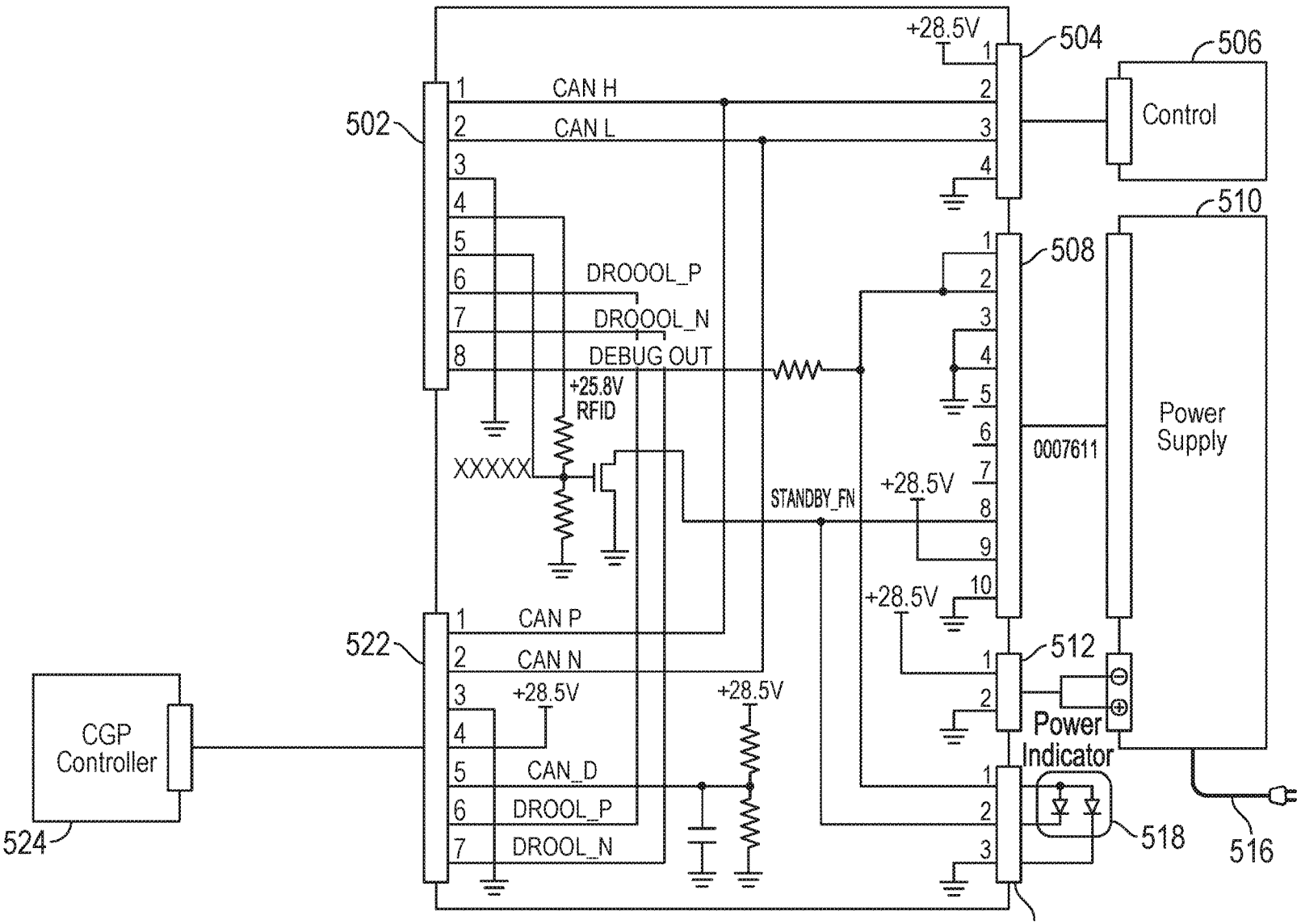
FIG. 5E shows the PCA layout for the modular add-on component.

FIG. 5E shows the PCA layout for a modular add-on component, such as the tray 116. As described above, the PCA layout may include a primary connector 502 for communicating control signals with the communications bus 362. The control signals communicated through primary connector 502 may be distributed via the PCA to a plurality of external ingredient pumps 120 or other such add-on modules. For example, the PCA may include a primary pump connector 504 for providing a control communication path from communications bus 362 to a controller of a primary external ingredient pump module 615. Primary pump connector 504 may also provide power from a power supply 510 to external ingredient pump module 615, as described in more detail below. In this example, primary external ingredient pump module 615 may one or more pumps for pumping a micro-ingredient from a single source to a corresponding plurality of micro-ingredient inlets on nozzle assembly 172 (e.g., micro-ingredient inlets on the injector ring 176). In some embodiments, the single micro-ingredient source may be a micro-ingredient sweetener source such as a non-nutritive sweetener (e.g., aspartame). Examples of a pump are described in U.S. Pat. No. 8,516,902, Product Dispensing System, filed Dec. 29, 2011, the entirety of which is hereby incorporated by reference. By locating the non-nutritive sweetener external to dispensing system 102, additional micro-ingredient cartridge/carton slots in micro-ingredient tower 162 within the dispenser may be made available for providing additional micro-ingredient options. For example, a further non-nutritive sweetener source may be provided in one of the freed-up slots in micro-ingredient tower 162. Such an additional non-nutritive sweetener source may include a steviol glycoside based sweetener such as a Reb A or Reb M sweetener or sweetener blend.

The PCA may also include a power supply connector 508 for connecting to power supply 510 that supplies power to the PCA and the associated add-on modules. Moreover, power supply connector 508 may receive a power supply input from primary connector 502. When power is being received from primary connector 502 a standby enable pin on power supply connector 508 may be driven such that power supply 510 provides power to the PCA and associated add-on modules. In contrast, when power is not being received from the primary connector a standby enable pin on power supply connector 508 may be driven such that power supply 510 enters a standby mode and reduces the power draw of the PCA and associated add-on modules. Therefore, when dispensing system 102 enters a standby mode, the power on primary connector 502 will be low such that the standby enable pin is driven to also put power supply 510 for the PCA and associated add-on modules in a standby mode also.

The PCA may also include a power supply connector 512 for receiving power supplied by power supply 510. A power indicator 518 may be driven based on signals received through indicator connector 520 to show different colors based on the operational state of the power supply. For example, power indicator 518 may be green when power is being supplied, yellow when power supply 510 is in the standby mode, and red when no power is being supplied.

The PCA may further include one or more expansion connectors 522. Expansion connectors 522 may correspond to the CGP1-CGP4 connectors shown in FIGS. 5A and 5D. While only one expansion connector 522 is shown, two or more expansion connectors 522 may be present. In the embodiment of FIG. 5A, there are four expansion connectors 522. Each of expansion connectors 522 may provide power from power supply 510 as well as provide a control communication path from communications bus 362 to a controller of the expansion module, a controlled gear pump module controller in this example.

FIGS. 6A through 6F show a primary tray 600. Primary tray 600 may comprise tray 116 and may also include external ingredient pump 120 and optionally external ingredient valve 122. Primary tray 600 may be embodied by node 385 described above and may include the PCA described above in conjunction with FIGS. 5A-5E. External ingredient 118 may be in a BIB and may be placed on top of primary tray 600. External ingredient 118 may comprise, for example, macro-ingredients or micro-ingredients. External ingredient 118, for example, may comprise a non-nutritive sweetener (NNS) (e.g. Aspartame.) Primary tray 600 may comprise a connector 605 (e.g. a BIB connector) for connecting external ingredient 118 to primary tray 600. Connector 605 may lead to a manifold 610 that may feed, for example, pump module 615 (e.g. external ingredient pump 120 and external ingredient valve 122.) Pump module 615 may include controller 506 described above in conjunction with FIG. 5E. Pump module 615 may connect to control architecture 200 of dispensing system 102 through communications bus 362 as described above with respect to FIGS. 3, 4, and 5A-5E. Each of the pumps on pump module 615 may comprise a micro-ingredient pump (e.g., vibratory piston pump, though other positive displacement pumps could be used). Pump module 615 may include controller 506 for pumping one or more of the pumps depending on the flow rate instructed. Pump module 615 may also include logic for interleaving the pumps to distribute the wear across the pumps. Each of the one or more pumps (e.g., four pumps in this example) may be plumbed to its own micro-ingredient inlet on a common nozzle (e.g. injector ring 176.) This configuration may be useful for NNS (e.g., aspartame) because, while many intendents have reconstitution ratios of 150:1, NNS may have a reconstitution ratio of 50:1 and may need to be pumped at a higher flow rate than the other ingredients.

In addition or as an alternative to pump module 615, primary tray 600 may include a controlled gear pump (CGP) module as describe in more detail below in conjunction with FIGS. 8A and 8B. The CGP module may connect to control architecture 200 of dispensing system 102 through communications bus 362 as described above with respect to FIGS. 3, 4, and 5A-5E. The CGP module may have a CGP for pumping macro-ingredients from primary tray 600 or a secondary tray 700. The CGP may be plumed to one of the macro-ingredient ports on the common nozzle (e.g. injector ring 176.)

Figure 7:
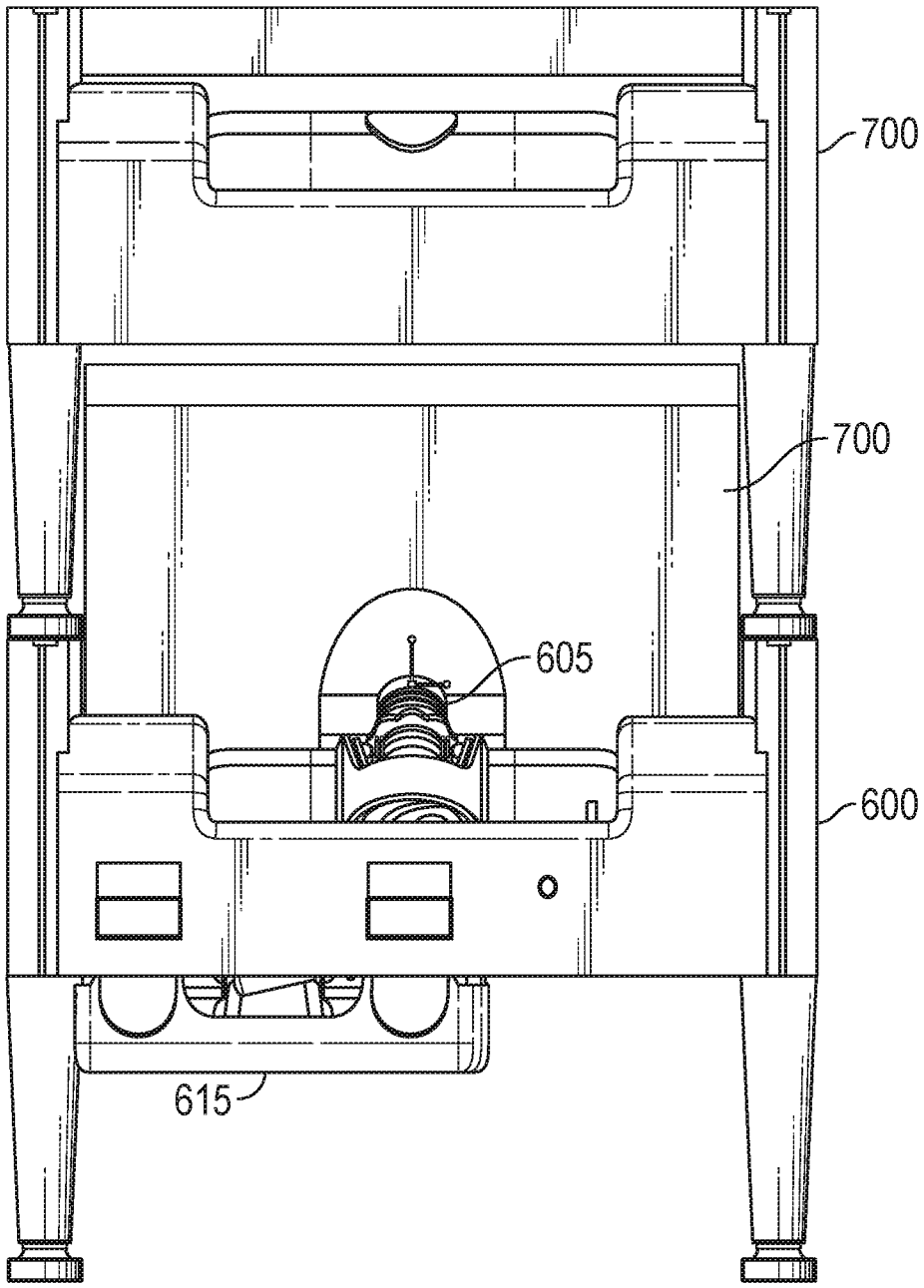
FIG. 7 shows a primary tray with a secondary tray stacked upon the primary tray.

FIG. 7 shows primary tray 600 with a secondary tray 700 stacked upon primary tray 600. As shown in FIG. 7, a primary BIB 710 (e.g. external ingredient 118 container) may be placed on and connect to primary tray 600. Consistent with embodiments of the disclosure, secondary tray 700 may be similar to primary tray 600 as described above and may support and connect with a secondary BIB (not shown.) Consistent with embodiments of the disclosure, secondary tray 700 may be stacked on top primary tray 600 and may include limited internal components (e.g. a BIB connector that is in fluid communication with a fluid connector for connecting a tube between secondary tray 700 and a controlled gear pump (CGP) module.) The CGP module may have an electrical connection from primary tray 600 for providing control signals to secondary tray 700's CGP module from control architecture 200.

Alternatively, other BIBs may be stacked on top of each other on primary BIB 710 on primary tray 600 or next to primary tray 600. A BIB connector may connect a CGP directly to one of the other BIBs and then the CGP may be plumed to the nozzle (e.g. a macro-ingredient port on injector ring 176.) The CGP module can be clipped to the side of primary tray 600.

Figure 8A:
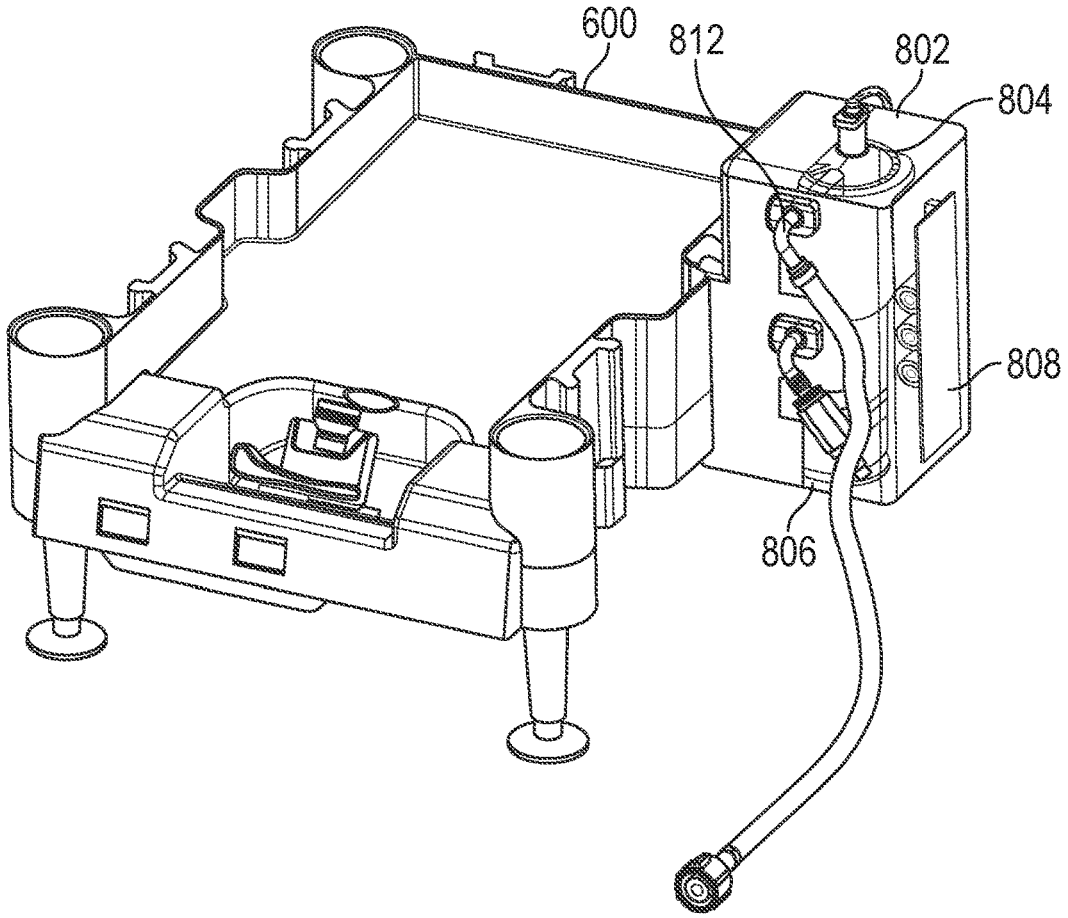
FIG. 8A shows a control gear pump (CGP) module clipped to the side of the primary tray.

FIG. 8A shows a control gear pump (CGP) module clipped to the side of primary tray 600. As shown in FIGS. 6A-6D and 8A, primary tray 600 may include a plurality of bosses along the perimeter of primary tray 600. The CGP module may include a housing 802 that includes a corresponding boss that cooperatively engages with one of the bosses on the perimeter of the primary tray 600. Accordingly, primary tray 600 can cooperatively receive and support the housing of the CGP module. In some embodiments one or more of secondary tray 700 may also have a boss for mounting housing 802 of the CGP module. In some embodiments, the CGP module may be mounted to primary tray 600 and may pump ingredients from a BIB on the secondary tray 700. Moreover, while not shown in FIG. 8A, the CGP module may include a CAN connector port. A CAN connector line may connect the CGP module with a corresponding CAN connector port on the back of primary tray 600. As described above in conjunction with FIG. 5E, the CGP module may receive power and control signals that control the operation of the CGP module via the CAN connection.

Figure 8B:
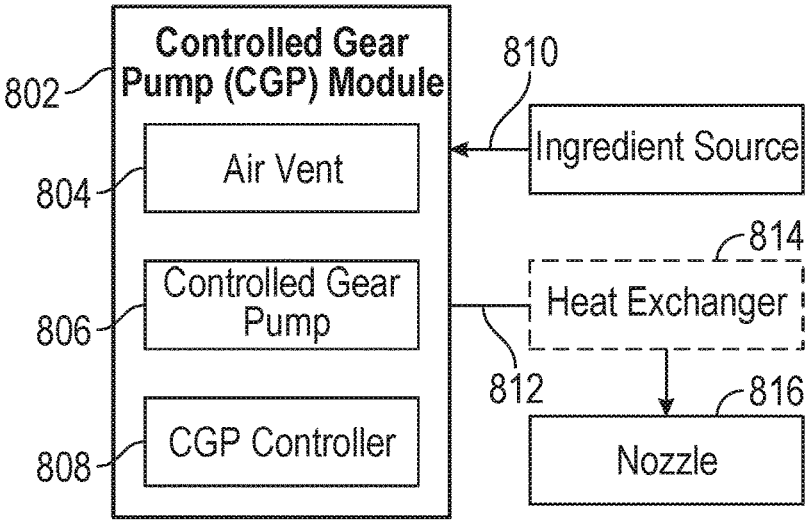
FIG. 8B shows a system diagram of the GCP module.

FIG. 8B shows a system diagram of the GCP module. The CGP module may comprise an air vent 804 and controlled gear pump 806 along with various valves (not shown). An embodiment of the operation and structure of air vent 804, controlled gear pump 806, and associated valves are described in PCT Patent Application Serial No. PCT/US15/028559, entitled Vacuum Side Air Vent, filed on Apr. 30, 2015, the entirety of which is hereby incorporated by reference. In general, the controlled gear pump 806 operates to pump a predetermined volume of a fluid every time the pump is cycled. Air vent 804 operates to separate and vent any air that may be entrained within any fluids from external ingredient source 118. CGP controller 808 provides control signals to air vent 804 and associated valves as well as controlled gear pump 806 based on instructions received via communications bus 362 from CDM 204 in the dispensing system. The CGP module includes an inlet 810 for receiving fluid from external ingredient source 118 and supplying the fluid to controlled gear pump 806 and air vent 804. The CGP module also includes an outlet 812 for supplying fluid pumped by controlled gear pump 806 to nozzle 816 (e.g., a macro-ingredient inlet port on injector ring 176 of nozzle assembly 172).

In some embodiments, the fluid from the CGP module may pass through a heat exchanger 814 to moderate the temperature of the fluid as desired before being dispensed from the nozzle 816. For example, the fluid from outlet 812 of one or more of the CGP modules may flow through one or more corresponding fluid circuits in a cold plate, cold water bath, or other such heat exchanger in dispensing system 102. In some embodiments, one or more CGP modules may be in fluid communication with heat exchanger 814 and one or more other CGP modules may be pumped at ambient temperature to the nozzle. For example, a first CGP module may pump an alternative nutritive sweetener to nozzle assembly 172 (in addition to macro-ingredient 110 which may be high fructose corn syrup or other such nutritive sweetener). In this example the alternative nutritive sweetener may be a fructose, glucose, or inverted sugar. Accordingly, it may be desirable to cool the alternative nutritive sweetener to a desired temperature for dispensing cold carbonated or still beverages. At the same time a second CGP module may pump a juice concentrate such as an apple juice concentrate. Upon mixing with cold water at the nozzle a finished apple juice beverage may have a desirable temperature even if the apple juice concentrate provided to the nozzle is at ambient temperature. Accordingly, the apple juice concentrate may be plumbed directly to the nozzle form the CGP module without first passing through heat exchanger 814. Additional CGP modules may further be added for additional ingredient sources as desired and provided to the nozzle in either temperature controlled or ambient fluid circuits. While embodiments are described herein using the CAN specification for the control communication protocol, other communication standards and components may be used.

While the specification includes examples, the disclosure's scope is indicated by the following claims. Furthermore, while the specification has been described in language specification to structural features and/or methodological acts, the claims are not limited to the features or acts described above. Rather, the specific features and acts described above are disclosed as example for embodiments of the disclosure.

What is claimed is:

1. A beverage dispensing system for mixing a number of beverage bases, and/or a number of beverage base components, and a diluent to create a beverage, comprising:

a beverage dispenser;

the beverage dispenser comprising a control architecture and a nozzle;

the beverage dispenser configured to provide one or more of an internally or externally positioned beverage bases, one or more beverage base components, and the diluent, to the nozzle under the control of the control architecture; and an external tray positioned remotely from the beverage dispenser, the external tray configured to provide an additional one of the beverage base components to the beverage dispenser, the external tray being under the control of the control architecture and comprising an external ingredient pump;

wherein the external tray comprises a primary tray and an external ingredient container disposed on the primary tray.

2. The beverage dispensing system of claim 1, wherein the external tray comprises:

a secondary tray stacked upon the primary tray; and an additional external ingredient container disposed on the secondary tray.

3. The beverage dispensing system of claim 2, wherein the additional external ingredient container comprises an additional bag-in-box (BIB).

4. The beverage dispensing system of claim 2, wherein the secondary tray comprises:

the additional external ingredient pump; and an additional external ingredient valve.

5. The beverage dispensing system of claim 1, wherein the primary tray comprises:

the external ingredient pump; and an external ingredient valve.

6. The beverage dispensing system of claim 1, wherein the primary tray comprises:

a connector connected to the external ingredient container; and a manifold configured to feed the external ingredient from the connector to the external ingredient pump.

7. The beverage dispensing system of claim 1, wherein the external ingredient pump comprises a controlled gear pump.

8. The beverage dispensing system of claim 1, wherein the one or more beverage bases comprise a macro-ingredient.

9. The beverage dispensing system of claim 1, wherein the one or more beverage base components comprise a micro-ingredient.

10. The beverage dispensing system of claim 1, wherein the one or more beverage base components comprise a non-nutritive sweetener (NNS).

11. A beverage dispensing system for mixing a number of beverage bases, and/or a number of beverage base components, and a diluent to create a beverage, comprising:

a beverage dispenser;

the beverage dispenser comprising a control architecture and a nozzle;

the beverage dispenser configured to provide one or more of an internally or externally positioned beverage bases, one or more beverage base components, and the diluent, to the nozzle under the control of the control architecture; and an external tray positioned remotely from the beverage dispenser, the external tray configured to provide an additional one of the beverage bases or one of the beverage base components to the beverage dispenser, the external tray being under the control of the control architecture and comprising an external ingredient pump;

wherein the external tray comprises a primary tray with an external ingredient container and a secondary tray with an additional external ingredient container; and wherein the secondary tray connects to the control architecture through the primary tray.

12. A beverage dispensing system for creating a beverage, comprising:

a beverage dispenser;

the beverage dispenser comprising:

a beverage dispenser controller;

a nozzle;

one or more internal micro-ingredient sources in communication with the nozzle via a micro-ingredient pump under the control of the beverage dispenser controller; and one or more internal macro-ingredient sources in communication with the nozzle via a macro-ingredient pump under the control of the beverage dispenser controller; and a stack of external trays positioned remotely from the beverage dispenser;

the stack of external trays comprising an external micro-ingredient source in communication with the nozzle via an external tray pump under the control of the beverage dispenser controller.

13. The beverage dispensing system of claim 12, wherein the external tray pump comprises a controlled gear pump.

14. The beverage dispenser of claim 12, wherein the stack of external trays comprises a primary tray and a secondary tray.

15. The beverage dispenser of claim 14, wherein the secondary tray connects to the beverage dispenser controller through the primary tray.

* * * * *